United States Patent [19]

Kearns

[11] 4,069,582

[45] Jan. 24, 1978

[54] JOHNNY BOLT CUTTER

[76] Inventor: Paul Kearns, 12009 Judson Road, Wheaton, Md. 20902

[21] Appl. No.: 778,596

[22] Filed: Mar. 17, 1977

[51] Int. Cl.[2] ..... B26B 17/00

[52] U.S. Cl. ..... 30/182

[58] Field of Search ..... 30/182, 241, 272, 184, 30/185

[56] References Cited

U.S. PATENT DOCUMENTS

| | | | |
|---|---|---|---|
| 226,756 | 4/1880 | Jones | 30/184 X |
| 1,587,464 | 6/1926 | Beghetti | 30/186 |

*Primary Examiner*—Jimmy C. Peters

*Attorney, Agent, or Firm*—Walter S. Pawl

[57] ABSTRACT

The cutter designed for the cutting of sunken bolts for the purpose of removing said bolts with nuts rusted thereon is comprised of a U-bolt having a head plate slidably mounted on the said U-bolt, a pair of jaw plates slidably mounted on the said U-bolt above said head plate and having opposing cutter jaws extending laterally therefrom and tapered towards short cutting edges for mounting over the outer end of a sunken base hold down bolt, and particularly over the outer end of a Johnny base hold down bolt with a nut that has rusted thereon so that the threaded shank passed threadedly through said head plate may be turned against the inner of said jaw plates to force the cutter edges together and cut off the end of said bolt without harm to said base and particularly said Johnny base, there being a pair of stop nuts threadedly engaging the outer ends of the U-bolt.

3 Claims, 3 Drawing Figures

JOHNNY BOLT CUTTER

BACKGROUND OF THE INVENTION

The field of the invention is the use of metal cutting tools for the purpose of cutting bolts which are not possible of removal in any other manner.

U.S. Pat. No. 1,361,798 of Peder Pederson which issued Dec. 7, 1920 discloses a cutting tool adapter for cutting nuts from bolts after the nuts have become rusted upon the bolt and removal in the usual manner is not possible. The cutting tool consists of a C-shaped frame, longitudinally aligned, perforated, head and foot portions integrally formed on said frame, the perforation in said head being threaded, an operating screw carried by said head through the perforation therein, a screw guide having a shank disposed through the body of said frame and detachably secured therein, a knife having a shank disposed through said guide and detachably secured to said screw, a knife having a shank disposed in the perforation of said foot portion and detachable therefrom, the blades of said knives being in opposed alignment, and a handle on the body of said frame adjacent one end thereof.

This reference has certain known inherent disadvantages such as the inability of the blade to grasp sunken bolt ends particularly within the cupped portions of the johnny base around said bolt ends, since the cutting edges are not extended laterally and tapered, and thus do not fit around sunken bolt ends within cupped portions of a johnny base around said bolt ends.

SUMMARY OF THE INVENTION

This invention relates to improvements in cutting tools, including a bolt cutter, particularly to a bolt cutter of Johnny base hold down bolts when said bolt ends are sunken with the cupped portions of a Johnny base, and it is possible to cut said bolt ends with the cutter jaws of the invention tapering toward short cutting edges.

One object of the invention is to provide a tool adapted for cutting bolts after the nuts have become rusted upon the bolt and removal in the usual manner is impossible.

A further object is to provide a cutter tool with jaw plates having cutter jaws tapering toward short cutting edges for use around sunken bolt ends within the cupped portions of the Johnny base around said bolt ends.

A further object is to provide a device of this type that is practical, simple in construction, positive in operation and cheap to make.

Further objects will become apparent in the following detail description of a preferred form of this invention, as illustrated in the accompanying drawings, wherein:

FIG. 1 is a side view of one form of the invention used on a sunken johnny bolt, FIG. 2 is a side view thereof with the jaws wide open, and FIG. 3 is a plan view thereof.

DETAILED DESCRIPTION OF THE INVENTION

Figure 1:
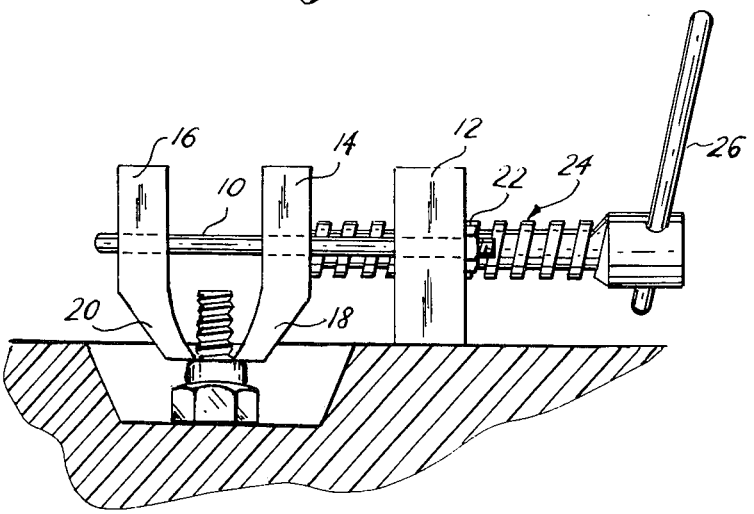
Figure 2:
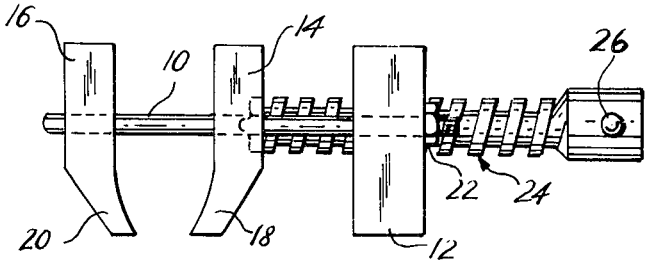
Figure 3:
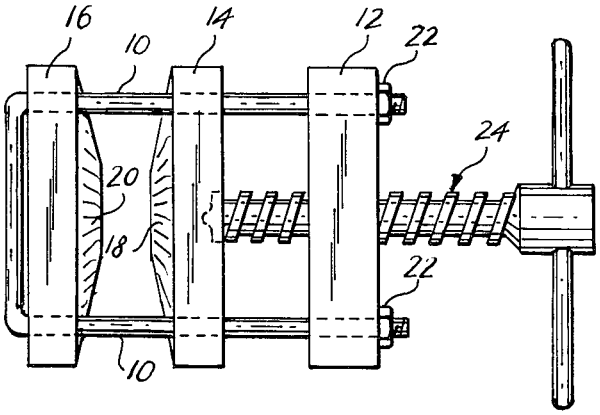

This cutting tool is composed of a U-bolt frame 10 on which a head plate 12 is slidably mounted against the base of the U. A pair of jaw plates 14 and 16, having laterally extending tapered cutter jaws 18 and 20, are slidably mounted on said U-bolt over said head plate, and nuts 22 are mounted on the ends of said U-bolt on the outside of said head plate, and the base of the U-bolt extends over the outer side of jaw plate 16 to provide an outer stop therefor. A threaded shank 24 is threadedly mounted in said head plate 12 for forcing said jaw plates together for cutting off the end of the bolt over which they may be placed. The threaded shank has a pin handle bar 26 in its outer end for easy turning of the shank 24.

This tool may also be used to cut off excessively protruding ends of newly installed and other sunken hold down bolts.

Although only one specific form of this Johnny bolt cutter is illustrated, many other modifications in details of structure may be made without departing from the spirit and scope of the present invention.

I claim:

1. A cutting tool comprising:

a. a U-bolt frame;

b. a header plate slidably mounted on said U-bolt against the ends of said U;

c. a pair of cutter jaw plates slidably mounted on said U-bolt inwardly of said header plate and having cutter jaws extending laterally therefrom;

d. said U-bolt having stop nuts threaded on its ends, and e. a threaded shank threadedly mounted through said header plate with a pin handle bar in its outer end for turning said shank to force the jaw plates together for cutting off the end of a bolt over which the cutter edges may be placed.

2. The device in claim 1 wherein said laterally extended cutter jaws are tapered towards short cutting edges.

3. A cutting tool for accomplishing the cutting of sunken bolt ends within the cupped portions of a Johnny base around said bolt ends, including:

a. a U-bolt frame;

b. a header plate slidably mounted on said U-bolt against the ends of the U;

c. a pair of cutter jaw plates slidably mounted on said U-bolt over said header plate, and having cutting jaws extending laterally therefrom, which are tapered towards short cutting edges as a means of cutting sunken bolt ends;

d. said U-bolt having stop nuts threaded on its ends, and a threaded shank threadedly mounted through said header plate with a pin handle bar in its outer end for turning said shank to force the jaw plates together for cutting off the end of a sunken bolt over which the cutter edges may be plated; wherein the improvement comprises:

a. cutting jaws which are tapered towards short cutting edges as a means of cutting sunken bolt ends, particularly sunken bolt ends sunken within the cupped portions of a Johnny base around said bolt ends;

b. jaw plates being forced together wherein the cutting edges of said jaw plates are tapered, thereby being a means whereby sunken bolt ends, particularly sunken bolt ends sunken within the cupped portions of a Johnny base around said bolt ends, can be cut, and particularly cut easily and efficiently.

* * * * *